US008800664B2

(12) United States Patent
Gollmyer et al.

(10) Patent No.: US 8,800,664 B2
(45) Date of Patent: Aug. 12, 2014

(54) NON-ROTATING BUOYANCY MODULES FOR SUB-SEA CONDUITS

(75) Inventors: Eric Gollmyer, Orange, CA (US); Norman Bruce Moore, Aliso Viejo, CA (US); Sarah Mitchell, Tustin, CA (US); Rudolph Ernest Krueger, IV, Cypress, TX (US)

(73) Assignee: WWT North America Holdings, Inc., Houston, TX (US)

( * ) Notice: Subject to any disclaimer, the term of this patent is extended or adjusted under 35 U.S.C. 154(b) by 534 days.

(21) Appl. No.: 12/844,751

(22) Filed: Jul. 27, 2010

(65) Prior Publication Data

US 2011/0017516 A1 Jan. 27, 2011

Related U.S. Application Data

(60) Provisional application No. 61/271,900, filed on Jul. 27, 2009, provisional application No. 61/274,022, filed on Aug. 11, 2009, provisional application No. 61/336,530, filed on Jan. 21, 2010.

(51) Int. Cl.
*E21B 17/16* (2006.01)
*E21B 17/10* (2006.01)

(52) U.S. Cl.
CPC ..... *E21B 17/1064* (2013.01); *E21B 17/1078* (2013.01)
USPC ..... 166/350; 166/335; 166/345; 166/351

(58) Field of Classification Search
USPC ..... 166/339, 343, 344, 345, 350, 360, 367; 405/222.2–222.4, 169
See application file for complete search history.

(56) References Cited

U.S. PATENT DOCUMENTS 1,764,488 A * 6/1930 Zublin ..... 175/325.3
3,074,083 A * 1/1963 Schirmer ..... 441/133
3,410,613 A 11/1968 Kuus (Continued)

FOREIGN PATENT DOCUMENTS

WO WO 95/10685 4/1995

OTHER PUBLICATIONS

International Search Report and Written Opinion for International Application No. PCT/US2010/043434; date of completion Mar. 30, 2011; date of mailing Jul. 5, 2011; 19 pages.

(Continued)

*Primary Examiner* — James Sayre
(74) *Attorney, Agent, or Firm* — Christie, Parker & Hale, LLP

(57) ABSTRACT

A buoyancy module assembly reduces the effective weight of a sub-sea conduit used in a deep-water wellbore drilling installation. The assembly includes a buoyant sleeve positioned around the conduit between upper and lower stop collar assemblies. The sleeve contains buoyant material forming most of its cross-section, with cross sectional segments thereof each encapsulated in a non-porous resinous material that forms an outer jacket around each segment. In one embodiment, a non-rotating generally circular inside diameter of the sleeve is formed by the thin layer of jacket material bonded directly to an interior reinforcing cage. A narrow gap is formed between the ID of the non-rotating sleeve and the OD of the conduit. The collar assemblies comprise an inner collar rigidly affixed to the conduit and contained within a larger diameter outer shell adapted for rotation relative to the fixed inner collar.

15 Claims, 11 Drawing Sheets

(56) References Cited

U.S. PATENT DOCUMENTS

| | | | | |
|---|---|---|---|---|
| 3,705,432 | A * | 12/1972 | Watkins, Jr. | 441/133 |
| 3,729,756 | A * | 5/1973 | Cook et al. | 441/133 |
| 4,021,589 | A | 5/1977 | Copley | |
| 4,040,165 | A * | 8/1977 | Miessler et al. | 29/458 |
| 4,086,971 | A | 5/1978 | Hall et al. | |
| 4,098,333 | A | 7/1978 | Wells et al. | |
| 4,437,791 | A | 3/1984 | Reynolds | |
| 4,477,207 | A * | 10/1984 | Johnson | 405/195.1 |
| 5,069,297 | A | 12/1991 | Krueger et al. | |
| 5,833,018 | A | 11/1998 | von Gynz-Rekowski | |
| 5,901,798 | A | 5/1999 | Herrera et al. | |
| 6,030,145 | A | 2/2000 | Stewart, Jr. et al. | |
| 6,155,748 | A | 12/2000 | Allen et al. | |
| 6,270,387 | B1 | 8/2001 | Nesheim | |
| 6,443,244 | B1 | 9/2002 | Collins | |
| 6,758,710 | B2 * | 7/2004 | Brown et al. | 441/133 |
| 6,821,055 | B2 | 11/2004 | Oram | |
| 6,896,062 | B2 * | 5/2005 | Davies et al. | 166/350 |
| 7,214,114 | B2 | 5/2007 | Gibson | |
| 7,293,940 | B1 * | 11/2007 | Perreau-Saussine et al. | 405/224.2 |
| 7,383,885 | B2 | 6/2008 | Bergeron et al. | |
| 2006/0062638 | A1 | 3/2006 | Bergeron et al. | |
| 2008/0017385 | A1 | 1/2008 | Gibson | |
| 2008/0289829 | A1 * | 11/2008 | Bergeron et al. | 166/350 |
| 2009/0126819 | A1 | 5/2009 | Beesley | |

OTHER PUBLICATIONS

Initiation to Pay Additional Fees and Communication Relating to the Results of the Partial International Search for International Application No. PCT/US2010/043434, Filed Aug. 24, 2010, Dated Apr. 7, 2011; 7 Pages.

* cited by examiner

NON-ROTATING BUOYANCY MODULES FOR SUB-SEA CONDUITS

CROSS-REFERENCE TO RELATED APPLICATIONS

This application claims priority to U.S. Provisional Application No. 61/271,900, filed Jul. 27, 2009; Application No. 61/274,022, filed Aug. 11, 2009; and Application No. 61/336,530, filed Jan. 21, 2010, each application incorporated herein by this reference.

BACKGROUND

Western Well Tool (WWT) has designed and produced a variety of non-rotating drill pipe protector assemblies that are used in drilling and completion work in oil and gas wells, as shown in U.S. Pat. No. 5,069,297; U.S. Pat. No. 5,579,854; U.S. Pat. No. 5,833,019; U.S. Pat. No. 6,250,405; U.S. Pat. No. 6,378,633; and U.S. Pat. No. 6,739,415, all of which are incorporated herein by this reference.

As part of the process to increase the utility of these non-rotating drill pipe protector assemblies, variations of the design can incorporate features that facilitate its use for a particular application, such as torque reduction, casing wear prevention, drag reduction, buckling load improvement, and pipe centralization within the casing. As part of this expansion of non-rotating drill pipe protectors, it is desirable, when operating inside a large diameter pipe, to use a large diameter non-rotating protector assembly to help centralize the pipe within the casing, which may be curved along its length. For example, when running 6⅝ inch drill pipe inside 13⅜ inch to 20 inch pipe, the non-rotating drill pipe protector sleeve outside diameter is typically about 9 inches. However, greater centralization within pipe is achieved when the sleeve diameter is increased to 10 or 18 inches or larger.

In addition to reducing drag and providing centralization within casing, a large enough protector of appropriate density will displace wellbore fluid and reduce the effective weight of the drill pipe in fluid. This practice has application in both drilling and casing landing operations as string weights continue to increase with well depth.

However, increasing the diameter of the non-rotating drill pipe protector sleeve, without increasing of the associated stop collar that holds the sleeve in place, may result in a substantially unprotected protrusion that can be caught on various irregularities, restrictions and wellbore equipment within the hole. The result is the assembly could be caught on a surface, resulting in damage to the non-rotating drill pipe protector, the pipe, or both. To avoid such potential damage, it is advantageous to have a collar assembly that is slightly smaller than the sleeve, thus providing a protective surface for the sleeve. However, as the size of the sleeves increase, the size of the collars can increase to the point that installation is difficult due to the weight of the collars. In addition, the gripping of the large diameter collars is more difficult to achieve when the associated bolts are tightened during installation.

To allow the use of larger diameter sleeves and collars without excessive weight of the collars or sleeves, this invention provides a solution. In addition, it is recognized that it would also be advantageous in sleeve manufacturing to have elements encased in an outer coating, thus providing adjustable rigidity and/or density. A process has also been developed to manufacture sleeves with a multiplicity of inserts having improvements described below.

SUMMARY OF THE INVENTION

One embodiment of the invention comprises a low density buoyant sleeve attached to a sub-sea conduit for increasing the buoyancy of the conduit when the conduit is installed in an underwater wellbore or used in a deep-water installation. The sleeve is made from a non-porous molded polymeric resinous matrix forming the body of the sleeve. A dispersion of finely divided elements having a closed structure with a hollow interior and a density less than water is embedded in and dispersed throughout the cross section of the resinous matrix, to increase its buoyancy. An abrasion-resistant coating or jacket is bonded to and encompasses the outside surface of the sleeve. The sleeve is secured to the conduit in a non-rotating configuration, between at least one stop collar at each end rigidly affixed to the conduit.

In other embodiments:

- The sleeve is held on the conduit by inner and outer collars at each end.
- The sub-sea conduit comprises a riser, a rotating drill pipe or a casing.
- The sleeve can be segmented to form circumferentially spaced apart and axially extending segments. The segments are encapsulated in an outer coating which can comprise a polyurethane material.
- The finely divided elements dispersed in the sleeve can comprise hollow spheres with a collapse pressure, in which the spheres can be made of glass, plastic, or metal.
- The sleeve's resinous matrix can comprise an epoxy resin.
- The sleeve segments have a density lighter than water, and the sleeve, as assembled, also has a density less than water.

These and other aspects of the invention will be more fully understood by referring to the following detailed description and the accompanying drawings.

DETAILED DESCRIPTION

Deep-Water Installation Using Non-Rotating Buoyancy Modules

Figure 1:
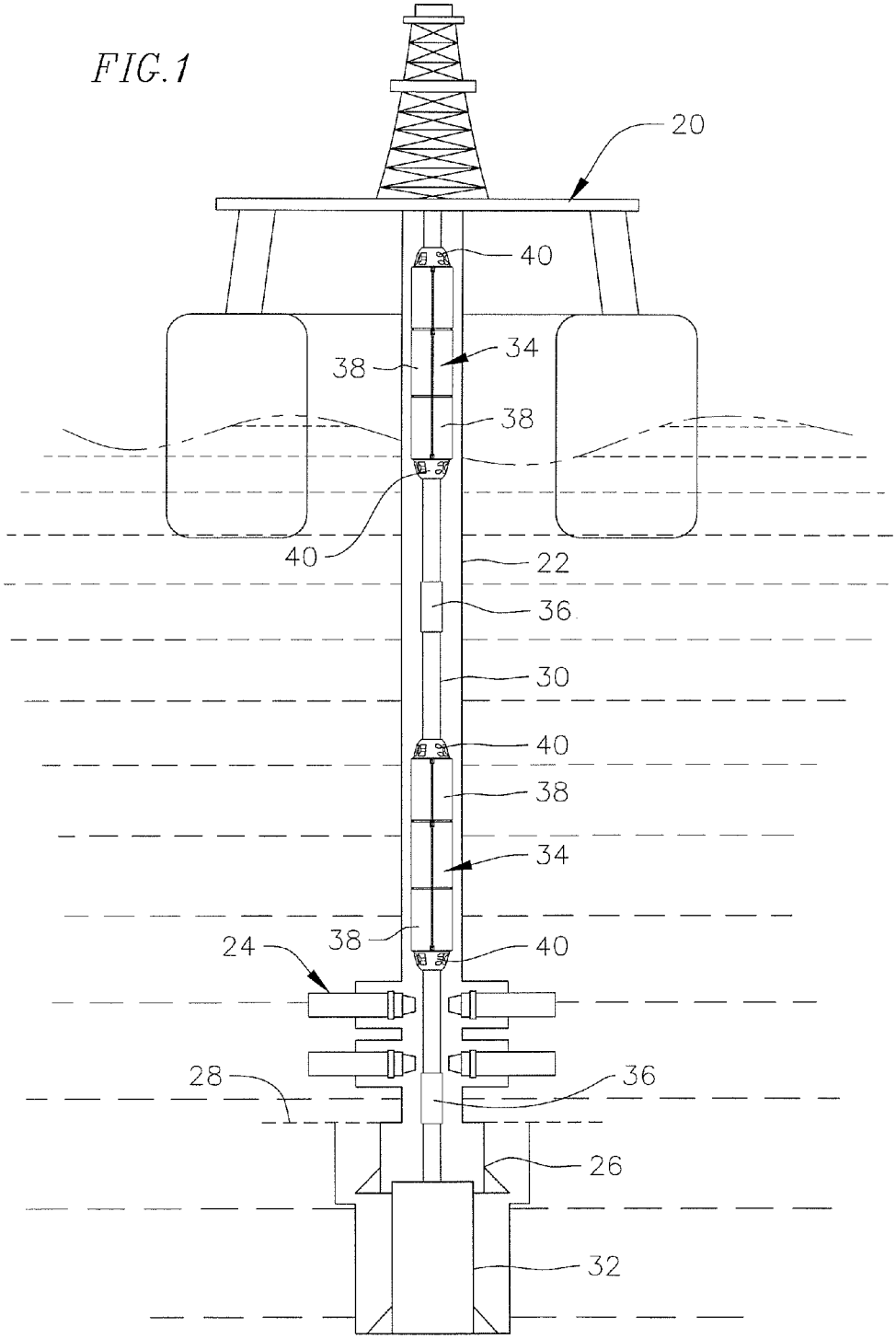
FIG. 1 is a schematic side elevation showing a deep-water installation in which the buoyancy modules of this invention are carried on a drill pipe used for running a liner into an open hole wellbore.

FIG. 1 illustrates one embodiment of a deep-water installation in which the non-rotating buoyancy module of this invention is used to increase the buoyancy of a conduit used in the installation.

In this embodiment, a semi-submersible offshore drilling rig 20 supports a riser 22 which runs underwater to a BOP 24 and a casing 26 set in the sea floor 28. A drill pipe 30 is lowered from the drilling rig through the riser to run a liner 32 into an open hole below the casing. (The casing and liner are not shown to scale and are proportionately longer in use.) A non-rotating buoyancy module assembly 34, according to this invention, is carried on the drill pipe to increase buoyancy. For simplicity only, one module is shown between tool joints 36, but in practice and as described below, multiple buoyancy module assemblies can be installed between adjacent tool joints.

Briefly, each buoyancy module assembly illustrated in FIG. 1 comprises a large-diameter non-rotating sleeve 38 positioned on the drill string between upper and lower fixed stop collar assemblies 40. The embodiment of FIG. 1 shows a series of side-by-side buoyant sleeves 38 between stop collars. The sleeve and stop collar assemblies are described in more detail below.

Exterior Shell Collar for Non-Rotating Drill Pipe Assembly.

Figure 2:
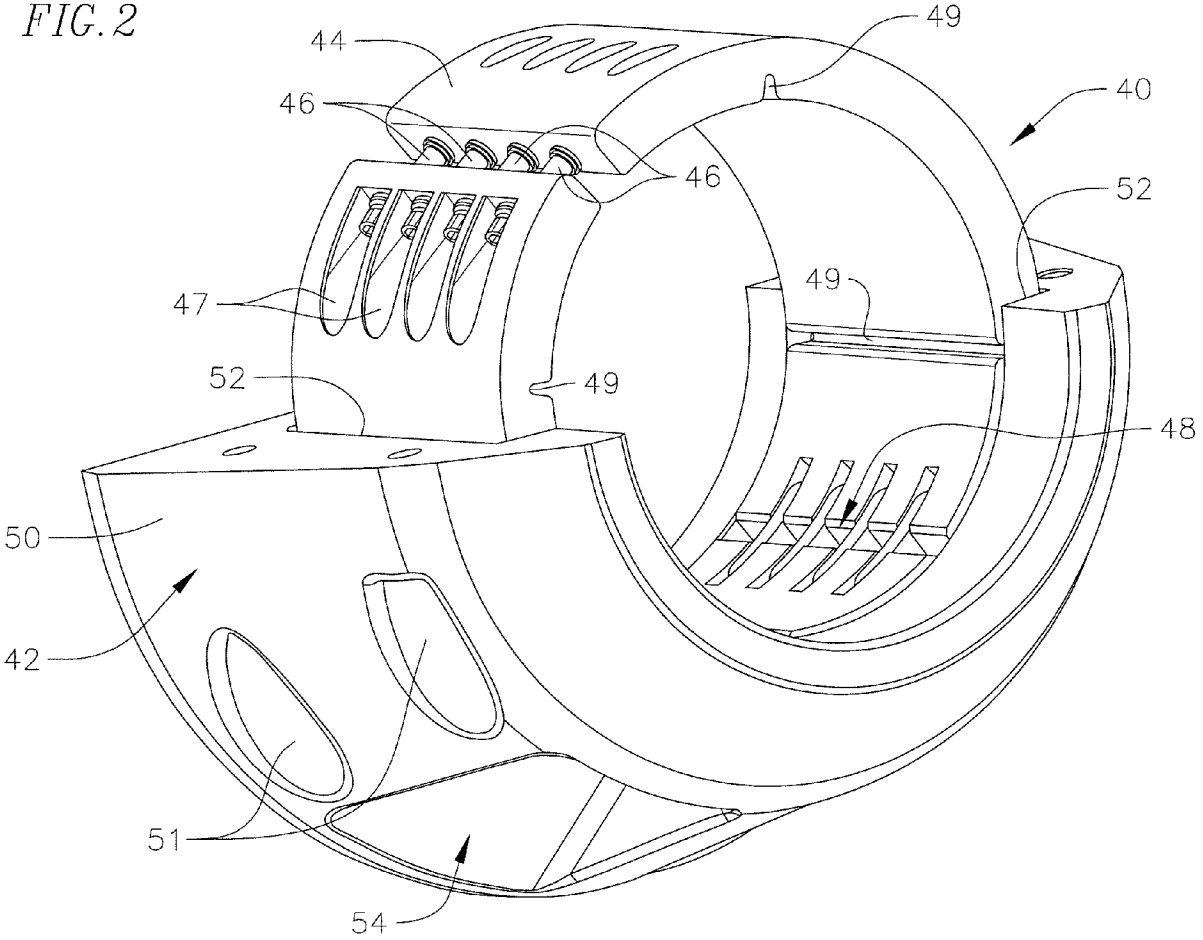
FIG. 2 is a cut-away perspective view showing an inner collar and an exterior shell collar as parts of an exterior collar assembly for a large-diameter non-rotating drill pipe protector sleeve.
Figure 3:
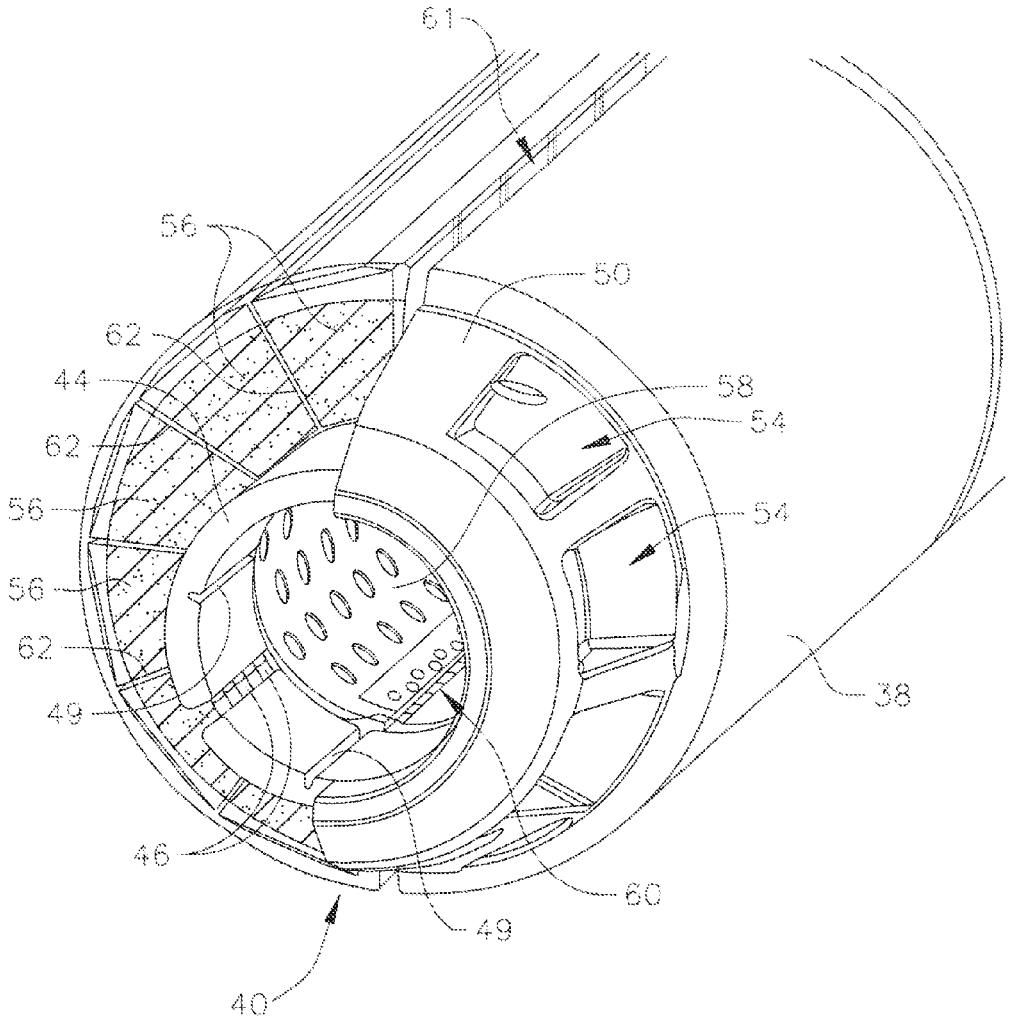
FIG. 3 is a cut-away perspective view showing components of the collar assembly of FIG. 2 installed next to a protective sleeve.

FIGS. 2 and 3 illustrate components of the stop collar assembly 40. In one embodiment, an exterior shell collar assembly 42 fits around an interior collar 44 that attaches to the drill pipe 30 or other sub-sea conduit. The collars, however, may be installed adjacent to one another axially along the drill pipe, should sufficient length be available. The exterior shell collar assembly 42 has a diametric taper to centralize the pipe 30 while moving through the rotary table, well head, and other restrictions. The exterior shell collar assembly 42 is designed to withstand impact loads while moving through well restrictions and to transfer the loads to the interior collar 44. The exterior shell collar reacts the axial load seen by the sleeves 38 when the drill pipe is down hole.

In one embodiment, the exterior shell collar is made from aluminum with multiple reinforced regions and some regions without material, providing high impact strength and low weight. In other embodiments, the external shell collar is made of plastic, rubber, or composite to further reduce the weight of the part.

The interior collar 44 is similar to the stop collars described in the several WWT patents listed above. In the preferred embodiment, the collar 44 is high strength aluminum with steel bolts 46 positioned in corresponding axially spaced recessed regions 47 on the outside of the interior collar. A hinged axis 48 extends along the side of the collar opposite from the split region that contains the fastener assembly. The collar has axial interior grooves 49 that allow the collar to adjust to variations of drill pipe diameter and maintain gripping force. Radial grooves may be included to further adjust the collar's flexibility for adequate gripping on drill pipe of varying diameter.

In FIG. 2, the collar assembly is shown with the inner collar 44 in its entirety and exterior shell collar assembly 42 in half. The exterior collar assembly captures the inner collar both axially and diametrically around the drill pipe. The exterior shell collar assembly 42 consists of two semi-circular halves 50 (one of which is shown) that bolt together around both the interior collar and the drill pipe. The two halves are bolted together with fasteners shown) inserted in recessed regions 51 in the outer surface of the two semi-circular halves 50. The exterior shell collar is larger than the interior collar to contain the interior collar both axially and diametrically. The outer surface of the exterior shell collar assembly is tapered wider (as a conical structure) from the drill pipe diameter (at its outer end) to a maximum diameter of approximately slightly less than the sleeve (spaced inboard from the end of the collar). This taper (or tapers) occurs over the axial length of the collar for producing an acceptable angular taper that ranges from 15-65 degrees. The exterior shell collar includes a cylindrical axial groove 52 formed on its inner surface, into which the interior collar fits.

In addition, the outer collar is designed with material removed at 54 to reduce weight of the outer collar, thus allowing it to be more easily lifted on the rig floor during installation. Further, decreased weight of the exterior shell collar limits the increase of overall drill string weight once the collar is installed. This can be important where large diameter protectors or sleeves are installed to displace fluid and provide buoyancy in operations where drill string weights are reaching critical limits.

The bolts 46 are used to hold the interior collar in place rigidly affixed to the drill pipe or other conduit. The torque is specifically selected to allow maximum gripping strength of the drill pipe without producing detrimental effects of significantly increasing the working stress state of the drill pipe. This can be important for applications with significant side loads or tensile loads that result in cyclic fatigue or excessive tensile loads. In one embodiment, the bolts 46 are of high strength steel and are torqued to 25-30 ft-lbs, which produces a gripping force of about 10,000 to 14,000 lbs around the drill pipe before movement.

In one embodiment, the material for either collar is high strength aluminum. Use of this material reduces over all weight and provides a soft material that can be easily drilled if the part is torn off and falls down hole into the well. Other materials may be considered for the components. For example, in another embodiment, each outer shell 50 can be made of a plastic or composite material such as phenolic, epoxy, urethane or other polymer. Alternative materials may be used for the interior collar 44 such as bronze or steel, reinforced plastic, or composite.

The inner collar assembly 40 is designed to allow rotation of the interior collar 44 relative to the outer protective shell collar assembly 42. This allows ease of installation and facilitates small levels of movement of the outer collar relative to the sleeve, during use.

Sleeve with Multiple Inserts.

FIG. 3 shows one embodiment of the sleeve portion 38 of the buoyancy module. In this embodiment, a multiplicity of inserts 56 of a material lighter than water allow a cylindrical sleeve 38 of approximately 16" OD to be installed to provide measurable buoyancy to the drill pipe 30 while submersed in fluid. Subsequently, the reduced weight and multiple components allow such a sleeve to be installed without lifting equipment. Multiple sleeves can be installed along the drill pipe 30 between tool joints 36 to displace large volumes of wellbore fluid and substantially reduce the drill string weight in fluid. That is, multiple sleeve/stop collar assemblies can be installed between adjacent tool joints, or multiple sleeves can be installed between each pair of stop collars.

Variations of the insert material, as well as the configuration of the inserts, allow the sleeve to vary in density and rigidity, while remaining sufficiently robust to withstand the loads experienced by the sleeve assembly during various operations. Grooves and flats (not shown) on the interior diameter of the sleeve may be incorporated to establish a fluid bearing for a non-rotating sleeve when the drill pipe is rotated within the sleeve or when rotating a casing. Alternatively, the sleeve can provide a non-rotating function in which a small gap (described below) is formed between the OD of the drill pipe and the ID of the sleeve.

In FIG. 3, sleeve and collar assemblies are shown as-installed with one half of one exterior shell collar removed to reveal the interior collar and one half of one sleeve transparent to reveal sleeve inserts 56, a perforated cage 58 and hinge 60. The sleeve 38 is split axially at 61, opposite from the hinge 60. The inserts 56 are fixed to the sleeve cage structure before casting an exterior polyurethane sleeve material, forming a jacket-type coating for complete encapsulation of each insert. The sleeve hinge eyes protrude beyond the polyurethane encapsulation in the molding process. This produces an axial groove along the sleeve for hinge pin access. The polyurethane is then cured, producing a sleeve body half that contains several components (the inserts). In the FIG. 3 embodiment, two sleeve body halves are placed around the pipe where a pin or bolt is run through the hinge eyes for the length of the groove formed in the sleeve. The two halves thereby encompass the cross-section of the sleeve.

By having ribs 62 of the more flexible polyurethane sleeve material between 56 inserts, a rigid insert material is subject to less bending loading during operation. This configuration effectively uses each material for its best-suited loading conditions. The rigid insert primarily experiences compressive loading while the softer jacket material experiences impact and bending loads.

Figure 4:
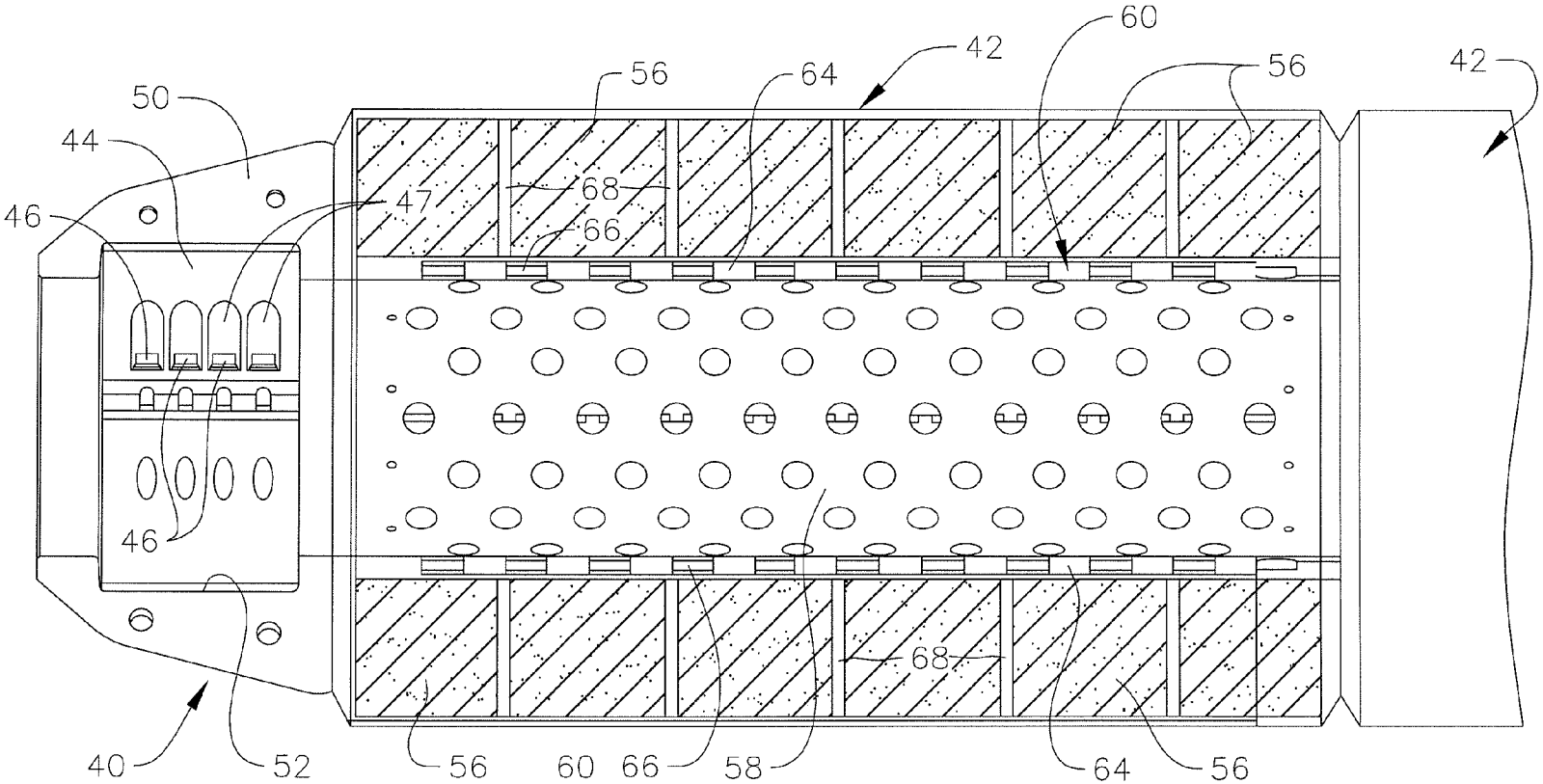
FIG. 4 is a cross-sectional view showing the collar assembly and sleeve components installed on a drill pipe or other sub-sea conduit.

FIG. 4 shows the positioning of the collar assembly 40 and sleeve assemblies 42 installed along a drill pipe shown (not shown) with one sleeve half and exterior shell collar half removed and another sleeve half semi-transparent. FIG. 4 also shows the sleeve's axial hinges (hinge eyes) 64 and hinge pins 66.

The sleeve structure is built on the perforated metal cage 58 which allows mechanical bonding between the cage and the polyurethane sleeve coating material. The inserts 56 are fixed to the sleeve cage before polyurethane casting. The insert ridges 68 create gaps between the inserts to allow the polyurethane to flow for complete encapsulation and isolation between inserts. In one embodiment, the outer coating encapsulates the entire sleeve, including the ID of the sleeve (thereby encapsulating the cage structure) to form a cylindrical sleeve ID that encompasses the OD of the drill pipe, when the sleeve is positioned around the drill pipe during use.

Significant Features.

(a) Internal and External Collar.

The diametric taper provides a gradual increase of diameter to allow the exterior shell collar assembly to move through the rotary table while protecting the sleeve from impact loads. In addition, the design has regions of reinforcement and other areas without material. This results in a high strength, high impact resistant, low weight structure.

Because the field installation is done in two parts, first the interior collar, and then the outer collar is installed, the separate parts have weights that are easily and quickly installed on the rig floor or an offsite location by an individual, without the need for lifting equipment.

The interior recess 52 allows the exterior shell collar to loosely fit onto the load-bearing interior collar. This feature reduces the precise dimensioning necessary in the exterior shell collar's manufacturing, thus reducing costs. It also allows the relative rotation of the two collars, thus accommodating some movement between the collar and the sleeve.

(b) Sleeve with Multiple Inserts.

Multiple inserts of materials of various hardness, density, and strength are incorporated into the sleeve design. This is distinguished over previous inserts of different material in that (1) the inserted material is completely encapsulated with the body of the sleeve, and (2) one element of the inserted material is separated from other elements thus allowing isolation of damage to a limited number of inserts, thereby allowing continued functioning of the sleeve.

(c) Test Method.

A method (illustrated in FIGS. 5 to 7) was developed for suspending the insert material samples inside the jacket material, thus uniformly encapsulating the insert material in one piece. This allowed the encapsulated composite insert to be tested to the pressures and loading that would occur once installed on drill pipe and placed down hole. This method or variation including mechanical fasteners would allow for complete encapsulation of the insert material in a full scale part.

Figure 5:
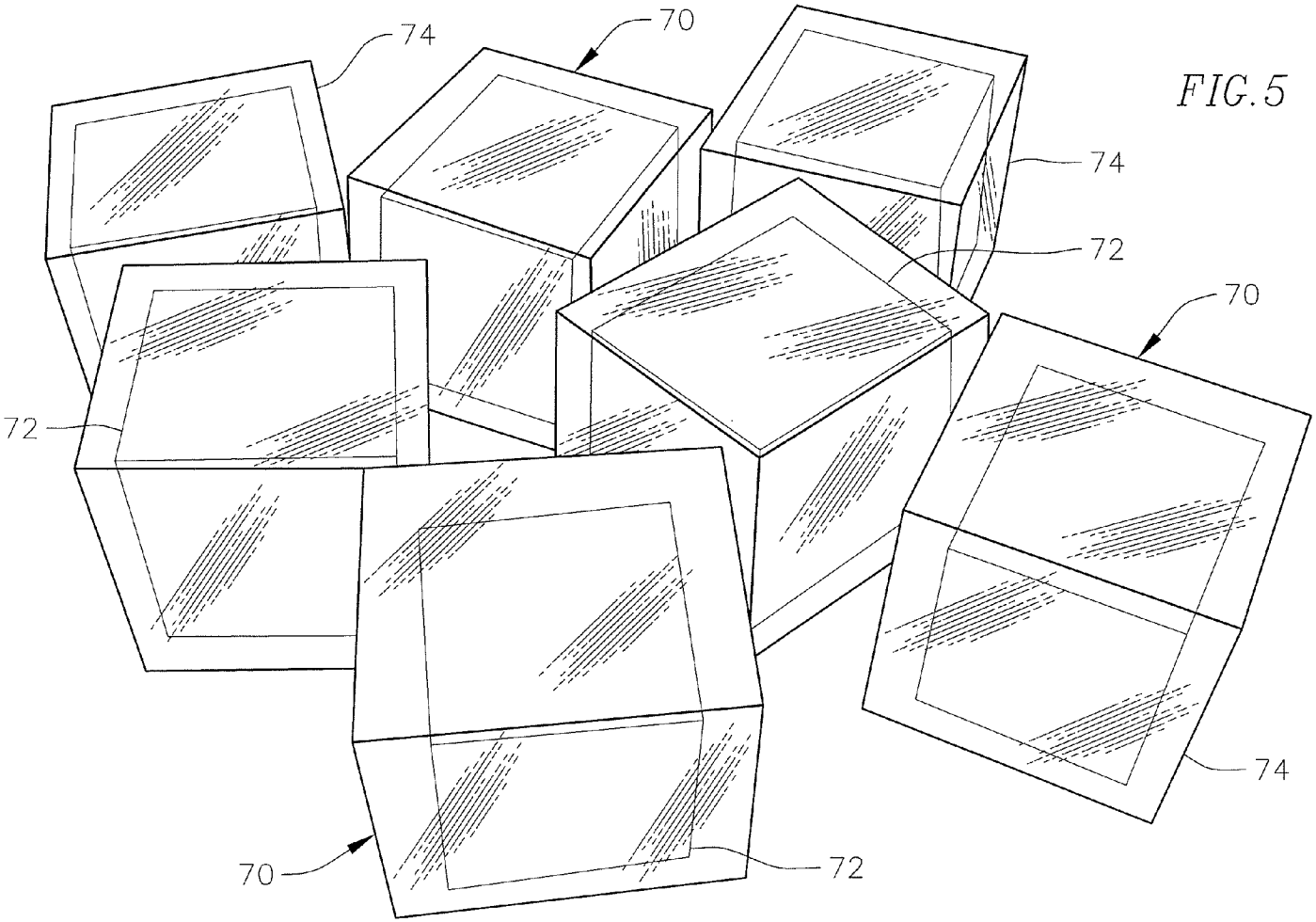
FIG. 5 is a perspective view of material samples of encapsulated insert material.

FIG. 5 shows material samples 70 depicting complete encapsulation of the insert material. The insert material is shown at 72 and the encapsulating material is shown at 74.

The sleeve can be of various materials including but not limited to plastics, composite, or elastomers. The material for the insert can be homogenous material such as a plastic with a greater or lesser hardness, strength, density, or rigidity. The inserts can also be heterogeneous composed of two or more constituents such as an epoxy with fiberglass, glass, graphite, Kevlar materials, that can themselves be homogenous or heterogeneous. Voids can be incorporated into the sleeve design to further adjust the structural characteristics.

Figure 6:
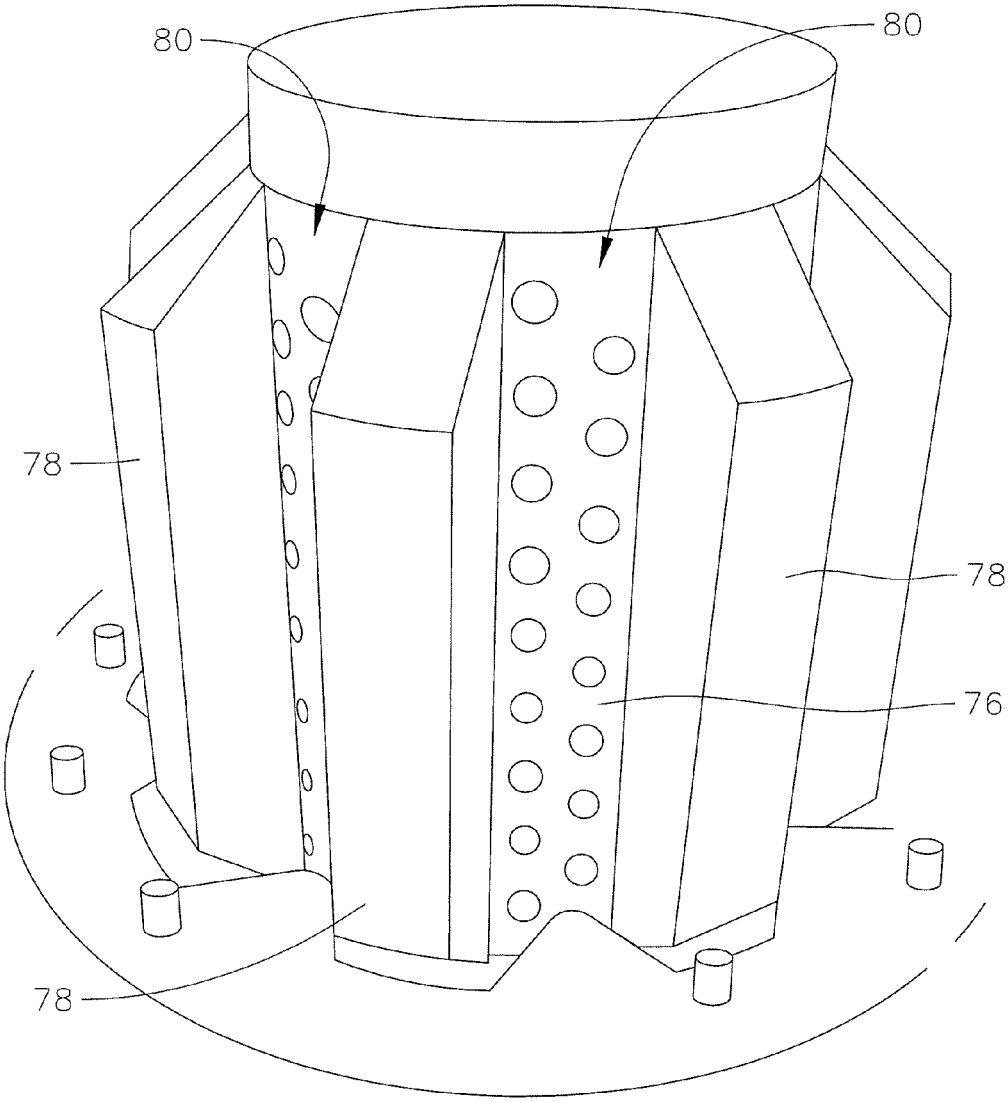
FIG. 6 is a perspective view showing a cage insert assembly prior to casting inside an exterior sleeve coating material.

FIG. 6 shows a cage 76 and insert assembly to be cast inside a polyurethane sleeve material, as part of the test method. The inserts 78 may be of various shapes including but not limited to bars, pie-like sections, semi-circles, spheres, cylinders, cubes or other convenient shape. Ridges may be included to provide separations between inserts to allow for jacket material to flow. This provides encapsulation of each individual insert which ideally localizes structural or fluid damage to one insert should such damage occur. The inserts also allow for adjustable rigidity as the jacket material can be more or less flexible than the insert material. Grooves 80, as shown in FIG. 6, are incorporated on the exterior of the sleeve between inserts in applications where annular flow-by is critical.

In one embodiment, as shown in FIG. 3, there are six inserts 56 in each half of the sleeve, or twelve inserts for a complete sleeve. The number of inserts per half-sleeve may vary from 1-100 depending upon the design requirements. Each of the inserts is completely encapsulated with a specific thickness of urethane that acts are a protective coating for each of the inserts. In one embodiment, the inserts may be filled with epoxy and fiber or spheres, which can increase or decrease the structural rigidity and sleeve density.

In one embodiment, the sleeve is made of a urethane plastic and the inserts are made of glass spheres in a resin matrix, such as syntactic foam. Experiments have shown that this material configuration provides adequate bonding between the urethane sleeve material and the composite insert. Further, experiments have shown that this formulation is structurally strong, resisting up to 8,000 lbs parallel-plate crushing force, depending upon the material used in the inserts.

An extensive process led to the selection of possible insert materials. In an attempt to decrease weight, various woods including balsa and bass were encapsulated in urethane. Entrained air, however, compromised the quality of the urethane jacket and the quality of the bond between the jacket and the insert material. Polyurethane foam and PVC foam were encapsulated with some success, but also included problems of entrained air similar to the wood materials. Also considered for use was a composite structure of hexagonal reinforcements of glass composite or aluminum. Encapsulating pressure vessels of spherical, cylindrical, and custom shapes within the sleeve material were considered. These materials and methods could have some application, should their mechanical characteristics meet structural demands of the application.

In the initial evaluation and testing, an insert material candidate that performed well and can be adjusted for specific applications is a composite material of hollow spheres in a resin matrix. The filler can be many materials including plastic microspheres, glass microspheres and metal spheres. Plastic microspheres of collapse pressure of 350 to 2,200 psi isostatic and density of 0.2 to 0.55 SG were considered. Metal spheres of varying density and collapse pressure were also considered. The matrix materials include, but are not limited to, epoxy, vinyl ester, polyester, and polyurethane. The general resulting composite is a lightweight yet rigid structure. By varying the constituents, a range of overall material rigidity and density can be achieved.

Many resins and fillers were tested. Several glass bubbles made by the 3M Company were evaluated including: K20, K25, S32, XLD3000, and IM30K. These glass microspheres vary in collapse pressure from 250 psi to 28,000 psi isostatic. Resins evaluated included epoxies made by BJB, West Systems, and Jeffco. Also, Derakane epoxy vinyl ester resin was evaluated and proved to be a potential matrix material.

In one embodiment the manufacturing method is as follows: Promoted Derakane epoxy vinyl ester resin is first catalyzed by 1% methyl-ethyl-ketone by resin volume. 3M K20 glass microspheres were mixed in catalyzed Derakane epoxy vinyl ester resin at an approximate ratio of 1:3.5 ratio by weight, respectively. This is approximately equal to 61% microspheres and 39% resin by total volume. The mixture is a slurry that can be cast into complex shapes like the inserts in the sleeve design. The properly catalyzed material allows sufficient time for the slurry to take the shape of a mold. Vibration has been shown to assist in proper mold fill and de-aerating the material as it cures. Once cured, the composite is a lightweight yet rigid material. This material can be encapsulated in the polyurethane jacket.

Encapsulation of the samples was done by staging the cure of the urethane. A base layer of urethane was allowed to gel while the insert material rested on top. This was followed by pouring urethane around the insert material. This produced homogeneous jacket once the urethane cured, as shown in FIG. 5.

A sample containing 3M K20 glass microspheres in BJB epoxy resin, encapsulated in an ⅛" polyurethane jacket was pressure tested to 6000 psi hydrostatically and suffered no structural damage.

Other embodiments include filler materials of varying densities that can provide improved flexibility or rigidity over the glass microspheres.

It has been shown in experimentation that encapsulation of approximately ⅛-¼ inch thickness of urethane material provide adequate coating armor for most of the abrasive and impact loads seen during operation of this configuration of protector assembly. Further, the material best-suited for the jacket has been found to be an aliphatic-aromatic blend polyurethane of 92 Shore D hardness. It withstands both the impact and compressive loading seen down hole. Further, it maintains its mechanical properties in most all drilling fluids and can be bonded well to the insert material.

Figure 7:
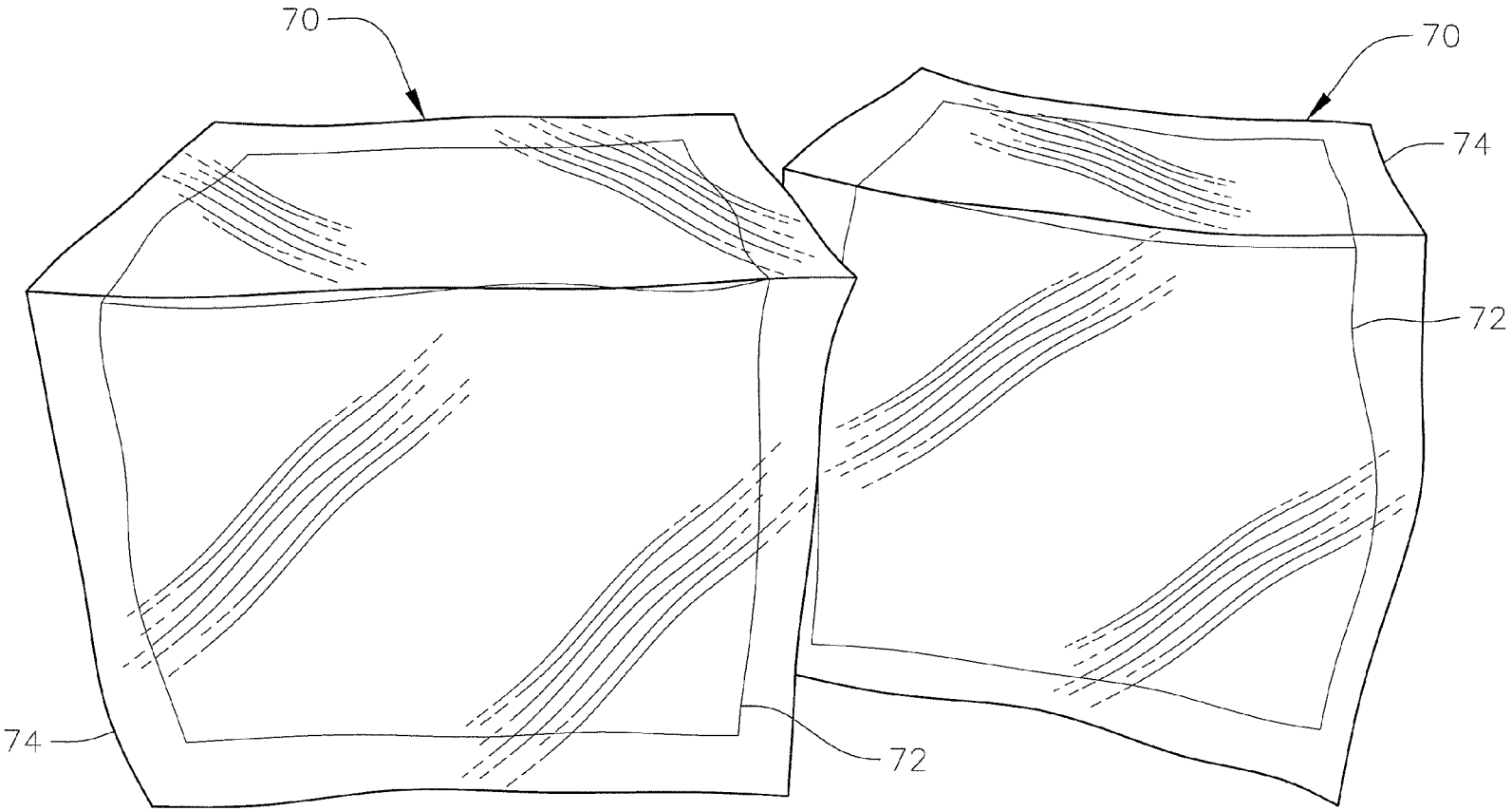
FIG. 7 is a perspective view showing material samples of FIG. 5 after destructive testing.
Figure 8:
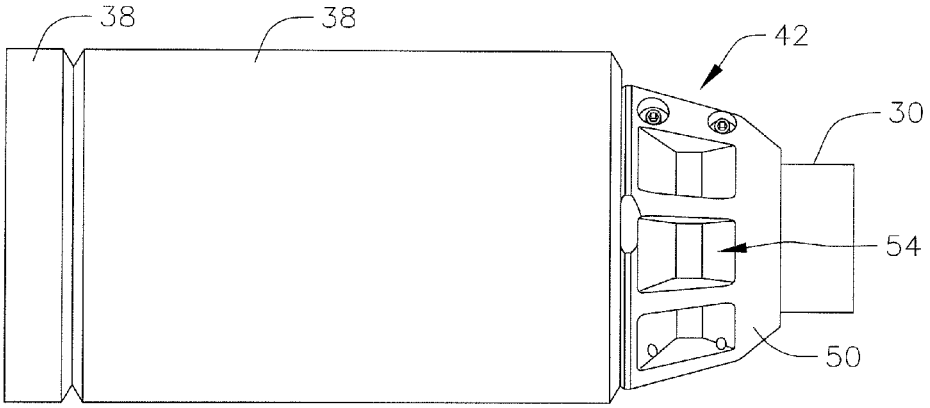
FIG. 8 is a side elevational view showing one embodiment of a floatation module on a drill pipe.

In FIG. 7, material samples 70 are shown after destructive testing. The samples show that the destruction of the insert material 72 is contained and held within the exterior polyurethane jacket 74.

In addition, the sleeve may include capability for opening the sleeve without disassembly or may be configured to not open without disassembly. In the latter configuration, the benefit is that more insert material may be included. In the former configuration, the sleeve may be opened in a single step of removing one of the pins and utilizing the hinge.

Benefits.

By increasing the diameter of the non-rotating drill pipe protector, standoff between the drill pipe and casing or riser wall is increased. This improves the protector's performance inside casing of highly-deviated wells and inside riser during conditions of high riser differential angles. A larger outer diameter improves centralization of the pipe within casing or riser which can dramatically reduce drag and prevent buckling during drilling, slide drilling, or tripping in the hole. An installation of large outer diameter protectors can displace an adequate volume of drilling fluid to substantially reduce the pick-up weight of a drill string. A reduction in drag also assists in effectively delivering weight to bit, particularly in horizontal sections.

In addition to the benefits provided while drilling, an installation of large outer diameter protectors can effectively reduce a casing landing string's effective weight in fluid. This may be achieved by installing large diameter protectors to drill pipe remaining in the riser as well as drill pipe miming into casing and liners. This allows longer casing strings, and an additional well design parameter, should adjustment to the drill pipe and mud weight be insufficient to complete the well.

The exterior shell collar allows for safer operation and protection of the one or more sleeve assemblies held between a pair of opposing collars along the pipe axially. The geometry mitigates the possible damage to the sleeve assembly while moving through the rotary table, well head and other restrictions. The exterior shell collar efficiently uses available length of drill pipe by fitting over the installed interior collar. The exterior shell collar effectively delivers impact loads to the structural interior collar.

The multi-segmented insertions in sleeve have the benefits of: (1) completely encapsulating the entire insert, thus providing protection from fluids, impact, and abrasion; (2) the materials are effectively insolated to prevent damage from one part significantly influencing the operation of the overall component; (3) proper selection of materials allow high levels of adhesion between sleeve jacket and insert thus increasing overall structural properties; and (4) the various insert materials and configurations allow for adjustable structural characteristics such as rigidity and density.

The insert materials to be used allow the inserts to be cast into complex shapes. This allows for the multi-segmented design and also eases manufacturing. Casting produces less waste and post-processing of the inserts is minimized. Further, mechanical fasteners can be included in the cast or added before urethane casting to fix the inserts to the internal sleeve cage structure. By suspending the inserts in the urethane mold, complete encapsulation of the inserts is achieved.

The modular design of the protector assembly allows for flexible installation of the protector sleeve and collar assembly which can take place while the drill pipe is running into the hole or offsite. Also, removal of the protector assembly allows for inspection of the drill pipe and reinstallation. The design also permits the reuse of the sleeve and collar assemblies for multiple installations.

EXAMPLES

Example 1

Inner Collar: ID=6.625 in. OD=7.375 in.
Outer Collar: ID=6.625 in. OD=17 in.
Sleeve: ID=6.675 in. OD=18 in.

Example 2

Inner Collar: ID=6.625 in. OD=7.5 in.
Outer Collar: ID=6.625 in. OD=10.5 in.
Sleeve: ID=5.625 in. OD=11.5 in.

Example 3

Inner Collar: ID=5.825 in OD=6.575 in
Outer Collar: ID=5.825 in. OD=14 in.
Sleeve: ID=6.0 in OD=15 in.

The range of the ID for the inner collar can be the same as the larger drill pipe—5 in., 5.5 in., 5.825 in., 6.625 in. The OD of the inner sleeve is approximately 1.5 inch larger than the pipe. The OD of the sleeve can range from 9-20 inches; the ID of the sleeve is approximately 0.125 inches larger than the drill pipe. The outer collar's ID is the same as the drill pipe it is attached to –5, 5.5, 5.825, 6.625 inches. The OD of the outer collar is approximately 0.5-1 inch smaller than OD of the sleeve for the sizes of interest.

Example 4

Improved Floatation Capacity Sleeves

A landing string floatation system of this invention can include a reduced number of floatation module inserts. In one embodiment, the syntactic foam module units can be reduced in number to two modules encompassing the OD of the conduit. This allows the use of more foam throughout the cross section, and thus increases floatation capacity.

Figure 9:
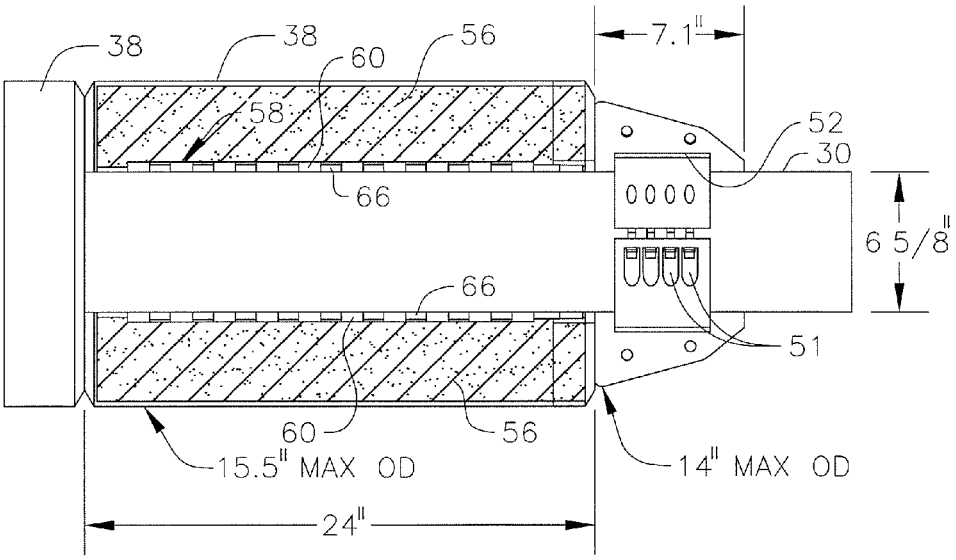
FIG. 9 is a cross-sectional view of the embodiment of FIG. 8 showing a module insert and inner collar.

FIGS. 8 to 11 show a floatation and collar assembly for a two module unit. FIG. 9 shows dimensions for a common (but not only) embodiment. FIG. 12 shows performance curves and calculations for floatation systems using different numbers of the (two unit) floatation module assemblies between drill pipe joints.

Figure 10:
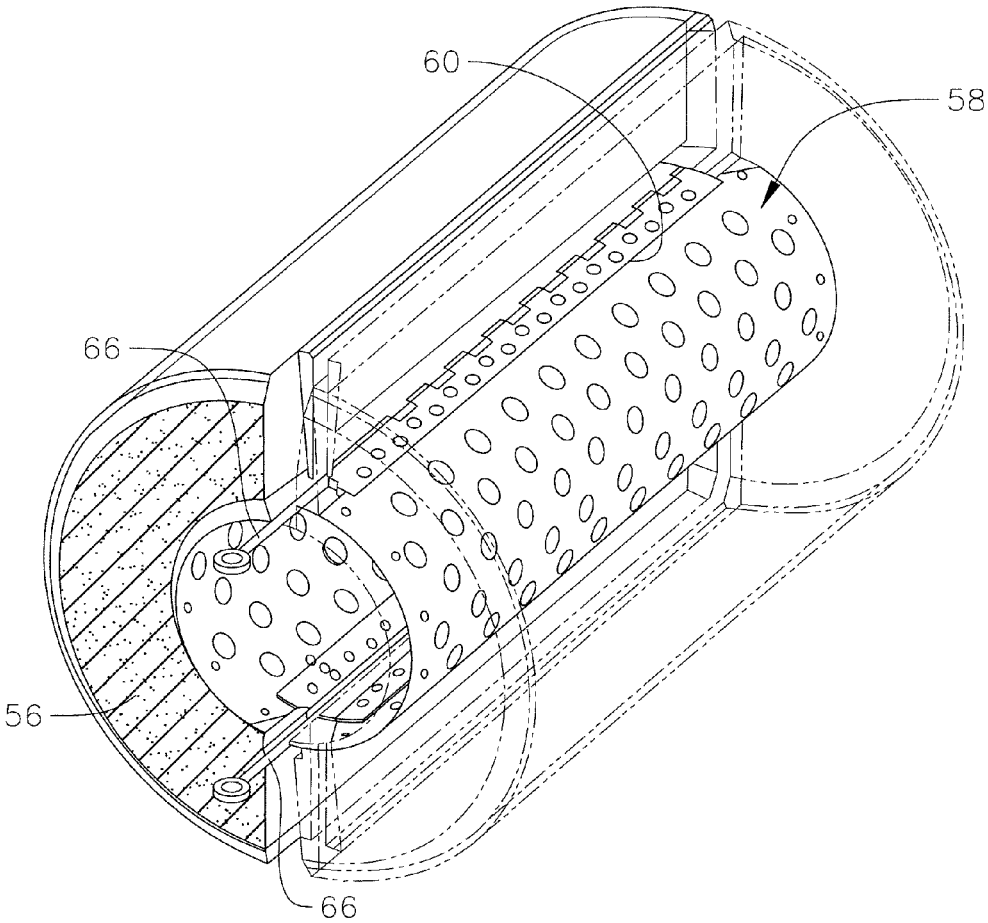
FIG. 10 is a cross-sectional perspective view showing the embodiment of FIGS. 8 and 9 to reveal the structural cage and pin insertion.
Figure 11:
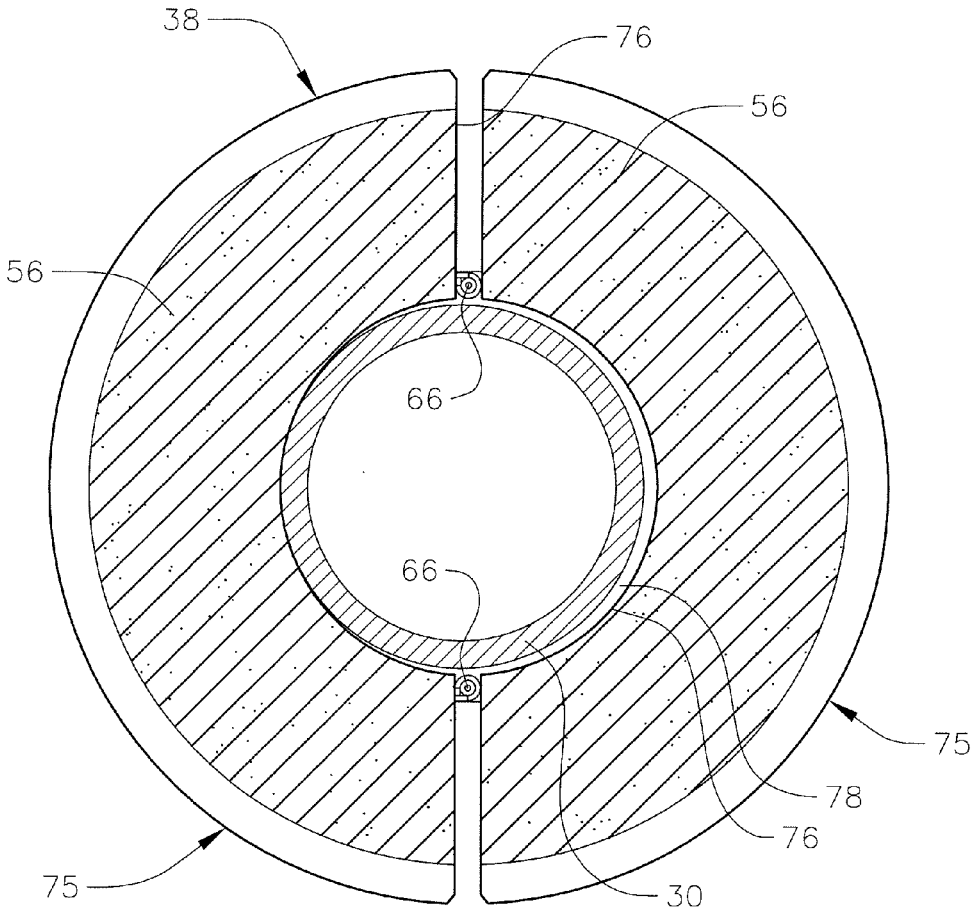
FIG. 11 is a cross-sectional view of the sleeve shown in FIGS. 8 to 10 installed on a drill pipe.
Figure 12:
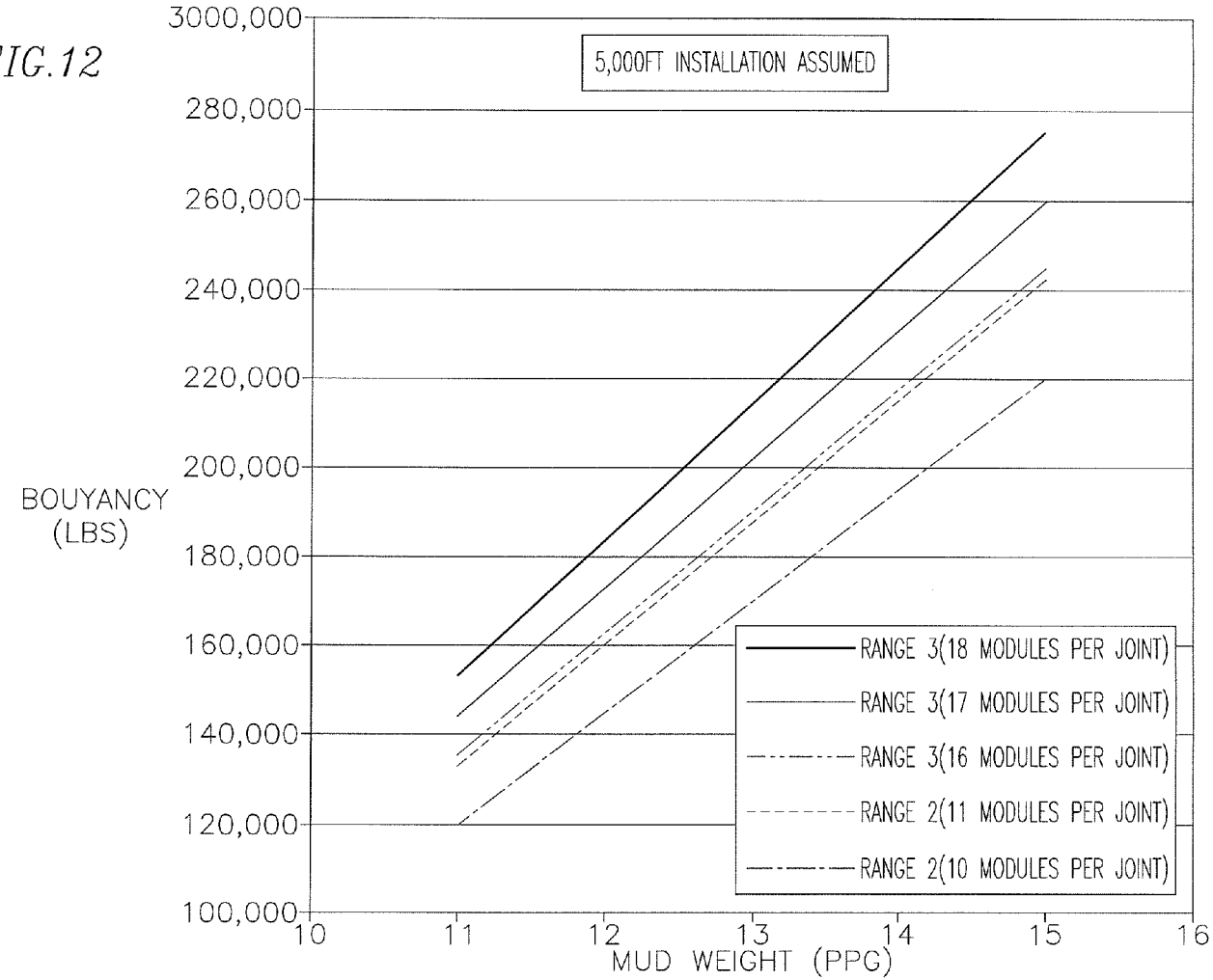
FIG. 12 is a graphic representation showing buoyancy performance for variations of mud weights and buoyancy module configurations.

In the embodiment shown in FIGS. 8 to 11, the sleeve 38 is in two parts, forming a half-shell 75 on each side of the drill pipe 30. Each half of the shell contains a one-piece insert 56 of the buoyant material, so in cross-section, as shown in FIG. 11, each insert encompasses about one-half the cross-section of the outer sleeve. Each half of the sleeve can be encapsulated in the outer jacket or coating, to form the protective layer 76 shown in FIG. 11. The resinous outer jacket material is molded to and bonds to the reinforcing cage along the ID of the sleeve. On the ID portion of the sleeve, the cage structure 58 is coated by the cured and hardened outer jacket material to form a (non-fluid bearing) circular ID surface around the inside of the sleeve. The sleeve is non-rotating in use, since the ID of the sleeve is structured to provide a narrow gap 78, shown in FIG. 11, between the OD of the drill pipe 30 and the ID formed by the thin coating on the two-part sleeve. The gap has a width of about ⅛ inch, in one embodiment. This allows the sleeve to rotate relative to the drill pipe (and relative to the collar assemblies) during use, enabling the sleeve to rotate out of trouble if the sleeve encounters irregularities or restrictions when moving down hole.

Appendix A shows the test data supporting the buoyancy performance curves in FIG. 10.

Summary of Unique Features of Invention—Improved Large Diameter Drill Pipe Protector.

Feature 1:

An apparatus of non-rotating drill pipe protector assembly consisting of double collars (collar within a collar) and large diameter sleeves.

- Both Collars are Aluminum
- Inner Collar is Aluminum and outer is plastic, rubber or composite material
- Outer collar has reinforcement ridges and non-reinforced sections
- Outer collar and inner collar have bolts
- Collars include thin and thick lateral miming grooves to adjust to drill pipe outside diameter variations.
- Collar weight is minimized to allow ease of field installation
- An attachment method consisting of more than one collar
  - With multiple collars adjacent to each other with different diameters
  - With collars within collars Feature 2:

An apparatus of non-rotating drill pipe protector assembly consisting of double collars and large diameter sleeves with multiplicity of encapsulated inserts.

- Inserts are made from material with density lighter than water (8.3 lbs/gal)
- Inserts are made of composite of resin (epoxy) matrix and encapsulated spheres
  - Hollow Spheres are made of glass
    - Hollow Spheres have specific collapse pressure from 200-15000 psi
  - Hollow Spheres are made of plastic
    - Hollow Spheres have specific collapse pressure from 100-5000 psi
  - Hollow Spheres are made of metal
    - Hollow Spheres have a specific collapse pressure from 500-15000 psi
  - Matrix is made of epoxy resin
- Inserts that are pressure vessels of different shapes including cylinders and custom shapes
- Multiple inserts are included to increase rigidity
- Multiple inserts are included to decrease weight in fluid
- Multiple inserts are encapsulated to isolate damage from fluid encroachment
- The encapsulating material is plastic
- The encapsulating material is urethane
- The encapsulating material has external grooves to increase fluid flow-by
- The encapsulating material has grooves on the interior between the sleeve and the drill pipe to facilitate assembly
- The ID of the sleeve can have a non-rotating function with the hinged cage embedded in the coating of the polymeric outer jacket material forming the ID of the sleeve.
- The encapsulating material can have axial grooves and flats (between the grooves) on the interior of the sleeve, to establish a fluid bearing when the pipe is rotated during drilling or while rotating casing. The fluid bearing can be configured as shown in any of the above-mentioned Western Well Tool patents.

Feature 3:

A method that uses large diameter non-rotating drill pipe [protector with double collars and large diameter sleeves with encapsulated buoyant inserts attached to drill pipe and used for drilling inside large diameter pipe.

Inside of casing

Inside of riser

Feature 4:

A method that uses large diameter non-rotating drill pipe protector with double collars and large diameter sleeves with encapsulated buoyant inserts attached to drill pipe used for running casing inside large diameter pipe.

Inside of casing

Inside of riser

Feature 5:

A method to manufacture large diameter sleeves with one or multiplicity of inserts.

Inserts are molded by mixing specific ratios of epoxy and glass spheres and catalyst Molded inserts are placed or attached close to the sleeve's cage reinforcement Cage with inserts in placed in a mold A urethane plastic is poured into the mold and thermally cured

What is claimed is:

1. A protective buoyancy module assembly for attachment to a sub-sea conduit to reduce the conduit's effective weight in deep-water applications, the buoyancy module assembly comprising:

a buoyant tubular sleeve adapted for positioning around a rotatable sub-sea conduit, the sleeve made from a non-porous, substantially rigid molded polymeric resinous matrix forming a generally cylindrical body of the tubular sleeve adapted to encompass the outer surface of the sub-sea conduit; a dispersion of finely divided elements having a closed structure with a hollow interior and a density less than water embedded in and dispersed throughout the cross section of the resinous matrix to increase its buoyancy; and a non-porous abrasion-resistant resinous outer coating formed as a thin jacket bonded to and encapsulating the surface of the tubular sleeve, the sleeve having an inside diameter adapted to encompass the conduit in a non-rotating configuration; and at least one stop collar assembly adapted for attachment to the conduit adjacent the sleeve for positioning the sleeve along the conduit, the stop collar assembly comprising an inner collar adapted for rigid attachment to an outside diameter of the conduit, the inner collar having an outside diameter less than the outside diameter of the sleeve, and an outer collar formed as a shell encompassing the outside diameter of the inner collar, the outer shell adapted for attachment to the inner collar, the outer shell having a maximum outside diameter less than the outside diameter of the sleeve, the inner collar positioned in a recessed interior region of the outer shell that allows relative rotation between the inner collar and the outer shell during use.

2. The buoyancy module assembly according to claim 1 in which the sleeve is divided into two or more segments spanning the cross section of the sleeve, the segments cooperating to encompass the outside diameter of the sub-sea conduit, each segment encapsulated in the outer coating or jacket.

3. The buoyancy module assembly according to claim 1 in which the outer coating or jacket material comprises a polyurethane resin, the resinous matrix comprises syntactic foam and/or an epoxy resin, and the hollow spheres are made of glass, plastic or metal.

4. The buoyancy module assembly according to claim 1 in which the sleeve includes a reinforcing cage adjacent to the inside diameter of the sleeve, the cage bonded to the buoyant cylindrical body portion of the sleeve, and in which the non-rotating inside diameter of the sleeve is formed by a generally cylindrical shaped interior surface formed by the resinous outer coating or jacket material bonded to the reinforcing cage portion of the sleeve.

5. The buoyancy module assembly according to claim 4 in which the inside diameter of the sleeve is adapted in its non-rotating configuration to form a narrow gap between the inside diameter of the sleeve and the outside diameter of the conduit.

6. The buoyancy module assembly according to claim 1 including one or more axial grooves formed along the inside diameter of the inner collar.

7. The buoyancy module assembly according to claim 1 in which the outer shell is tapered narrower axially away from the inner collar.

8. A deep-water buoyant well bore drilling installation, comprising:

a rotatable sub-sea conduit;

a protective buoyancy module assembly secured to the sub-sea conduit to reduce its effective weight in deep-water applications, the buoyancy module assembly comprising:

(a) a buoyant tubular sleeve positioned around the sub-sea conduit, the sleeve made from a non-porous, substantially rigid molded polymeric resinous matrix forming a generally cylindrical body of the tubular sleeve; a dispersion of finely divided elements having a closed structure with a hollow interior and a density less than water embedded in and dispersed throughout the cross section of the resinous matrix to increase its buoyancy; and a non-porous abrasion-resistant resinous outer coating formed as a thin jacket bonded to and encapsulating the surface of the tubular sleeve, the sleeve having an inside diameter encompassing the conduit in a non-rotating configuration; and (b) at least one stop collar assembly affixed to the conduit adjacent the sleeve for positioning the sleeve along the conduit, the stop collar assembly comprising an inner collar rigidly secured to an outside diameter of the conduit, the inner collar having an outside diameter less than then an outside diameter of the sleeve, and an outer collar formed as a shell encompassing the outside diameter of the inner collar, the outer shell secured to the inner collar independently of the conduit, the outer shell having a maximum outside diameter less than the outside diameter of the sleeve, the inner collar positioned in a recessed interior region of the outer shell that allows relative rotation between the inner collar and the outer shell during use.

9. The installation according to claim 8 in which the sleeve is divided into two or more segments spanning the cross section of the sleeve, the segments cooperating to encompass the outside diameter of a sub-sea conduit, each segment encapsulated in the outer coating or jacket.

10. The installation according to claim 8 in which the outer coating or jacket material comprises a polyurethane resin, the resinous matrix comprises syntactic foam and/or an epoxy resin, and the hollow spheres are made of glass, plastic or metal.

11. The installation according to claim 8 in which the sleeve includes a reinforcing cage adjacent to the inside diameter of the sleeve, the cage bonded to the buoyant cylindrical body portion of the sleeve, and in which the non-rotating inside diameter of the sleeve is formed by a generally cylindrical shaped interior surface formed by the resinous outer coating or jacket material bonded to the reinforcing cage portion of the sleeve.

12. The installation according to claim 11 in which the inside diameter of the sleeve is greater than the outside diameter of the conduit so that in the sleeve's non-rotating configuration, a narrow gap is formed between the inside diameter of the sleeve and the outside diameter of the conduit.

13. The installation according to claim 8 including one or more axial grooves formed along the inside diameter of the inner collar.

14. The installation according to claim 8 in which the outer shell is tapered narrower axially away from the inner collar.

15. The installation according to claim 8 in which the conduit comprises a drill pipe lowered from a drilling rig and supporting a liner being run into a wellbore.

* * * * *